United States Patent [19]

Borrow

[11] 4,015,646

[45] Apr. 5, 1977

[54] LIQUID DISPENSING APPARATUS

[76] Inventor: Edgar W. Borrow, Padnell Grange, Cowplain, Portsmouth, Hampshire, England

[22] Filed: Sept. 24, 1975

[21] Appl. No.: 616,493

[30] Foreign Application Priority Data

Sept. 27, 1974 United Kingdom ..... 42174/74

[52] U.S. Cl. ..... 141/34; 141/239; 141/283

[51] Int. Cl.[2] ..... B65B 1/14

[58] Field of Search ..... 141/234–247, 141/100, 34, 283, 1; 137/262

[56] References Cited

UNITED STATES PATENTS 1,488,603 4/1924 Kouwenhoven ..... 141/238

*Primary Examiner*—Houston S. Bell, Jr.

*Attorney, Agent, or Firm*—Leydig, Voit, Osann, Mayer & Holt, Ltd.

[57] ABSTRACT

A circular dispensing tray having an upturned peripheral flange is formed with a first plurality of apertures in a central circular area and a second plurality of apertures in a surrounding annular area divided from the central area by an upward step. Each aperture contains a drinking vessel with its rim flush with the surrounding tray. An amount of liquid sufficient to fill all the vessels up to a level just below the rim is poured into the tray flooding the central area vessels; the tray is tilted to allow excess liquid to run over the step and the tray is rotated to fill all the vessels to the same level.

5 Claims, 3 Drawing Figures

LIQUID DISPENSING APPARATUS

BACKGROUND OF THE INVENTION

This invention relates to apparatus for dispensing predetermined quantities of liquid.

More particularly the invention is concerned with providing means for filling a large number of drinking vessels simultaneously for use in a school, hotel, conference, exhibition or other gathering of people in which it may be necessary to fill and distribute a large number of vessels in a very short time.

SUMMARY OF THE INVENTION

According to the present invention there is provided liquid dispensing apparatus comprising a peripherally flanged tray having a downwardly-stepped central area surrounded by an annular outer area, both areas of the tray containing a plurality of apertures in which drinking vessels are removably fitted and sealed with the rim of each vessel flush with the adjacent area of the tray in which it is received.

The present invention also provides liquid dispensing apparatus comprising a tray, the surface of the tray having a central circular area separated by an annular upward step from a surrounding annular area, the annular area being bounded by an upwardly directed flange, each said area having a plurality of apertures therein, an equal plurality of drinking vessels removably sealed in said apertures with the rim of each vessel flush with the part of the tray defining the aperture in which it is received, means supporting the tray for rotation about an axis through its centre perpendicular to the plane of the central area, and means supporting the tray for tilting movement about a horizontal axis.

DESCRIPTION OF THE DRAWINGS

One embodiment of apparatus in accordance with the invention is illustrated in the accompanying drawing in which.

DESCRIPTION OF THE PREFERRED EMBODIMENT

Figure 1:
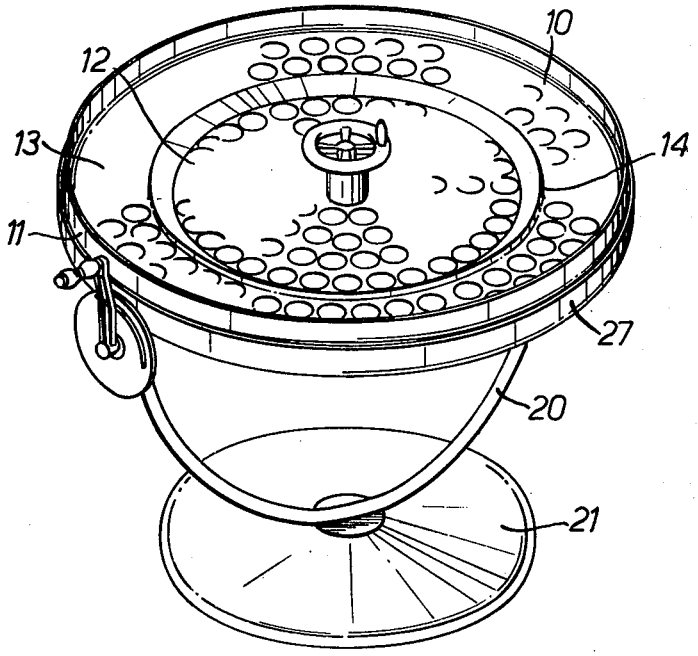
FIG. 1 is a perspective view of the apparatus.
Figure 3:
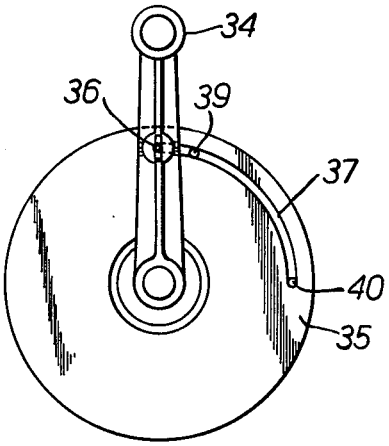
FIG. 3 is a fragmentary view as seen from the left-hand side of FIG. 2.
Figure 2:
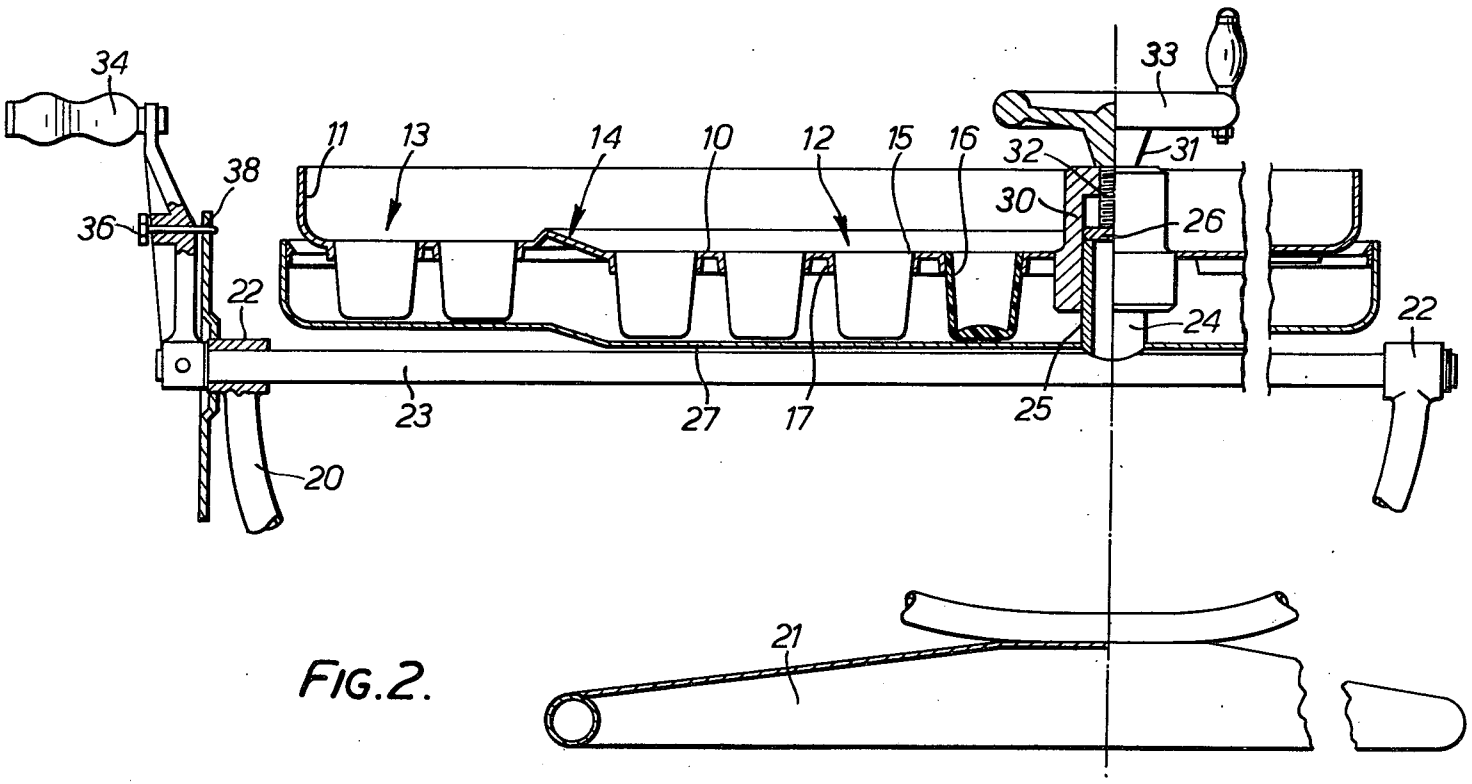
FIG. 2 is a section in a vertical plane through the apparatus of FIG. 1.

As shown in the drawing, the apparatus comprises a circular dispensing tray 10 having an upturned peripheral flange 11 and having a central circular area 12 divided from an outer annular area 13 by an upward annular step 14.

Each of the areas of the tray contains a plurality of circular apertures 15 for receiving drinking vessels 16, such as plastic cups. The apertures are arranged close to each other but with sufficient space therebetween to give adequate strength to the tray.

The step 14 between the central and outer areas is designed to allow excess liquid to flow smoothly from the central area 12 to the outer area 13 when the tray is tilted through a small angle, for example 15° . Accordingly the step is not abrupt but instead is formed with a ramp-like surface extending upwardly from the central area at an angle of about 15° to the horizontal. The upper edge of the ramp-like surface is slightly above the surface of the outer area 13 and is joined to it through a short downwardly-inclined surface.

To give one example, a suitable tray has the following dimensions:

| | |
|---|---|
| Diameter of tray: | 51 inches (130 cm.) |
| Distance between upper edge of ramp-like surface and outer edge of tray: | 6⅛ inches (15 cm.) |
| Total number of apertures for receiving drinking vessels: | 150 |
| Diameter of apertures: | 2⅞ inches (7.3 cm.) |
| Width of ramp-like surface: | 1 inch (2.5 cm.) |
| Width of short inclined surface: | ¼ inch (0.6 cm.) |
| Dimensions of drinking vessel: | |
| Outer diameter of rim: | 2⅞ inches (7.3 cm.) |
| Outer diameter of base: | 2¼ inches (5.7 cm.) |
| Depth: | 3⅛ inches (8.0 cm.). |

In order to seal a vessel in its receiving aperture, each aperture is formed with an accurately-shaped downwardly-turned circular flange 17, and the vessel is fitted into the flange so that the rim of the vessel lies in the plane of the surface of the aperture.

In order to fill the vessels fitted within the apertures, a quantity of liquid is measured out such as will fill all the vessels up to a level three eighths of an inch (1 cm.) below the rim of the vessel. Upon pouring all of this bulk of liquid into the centre of the tray, the liquid will run into the vessels of the central area flooding them, and some liquid will flow over the step on to the annular outer area 13. If now the tray is tilted until a line joining the centre of the central area 12 of the tray to the rim of the peripheral flange 11 of the tray is almost horizontal, all the vessels along this radial line will fill up to the top with liquid, and by rotating the tray around its centre so that each radial portion of the tray is brought to the same inclination successively, the excess liquid will roll around the tray and run equally into all the vessels. Furthermore, since all vessels are tilted simultaneously at a common angle, any that have been filled to the brim will lose a portion of their filling which will be added to the pool of liquid which is rolled around the outer area until all the vessels are filled to the same level. When the tray is tilted back again into the horizontal plane, the liquid filling of all the vessels will lie at the desired level below the rim of the vessels.

It will be apparent that by a simple rotational movement through 360° or a little in excess of 360° , all the liquid can be caused to flow into the vessels and all the vessels filled to exactly the same level.

A support for the dispensing tray is formed by a semi-circular mounting bracket 20 which is rigidly attached at its centre to a mounting stand 21. The ends of the bracket, which are directed upwardly, form journals 22 for a horizontal supporting shaft 23. A post 24 upstanding from the centre of the shaft fits within and supports a sleeve 25 which is closed at its upper end 26. This sleeve is secured at the centre of a peripherally flanged plate 27 whose diameter is slightly greater than that of the dispensing tray.

The dispensing tray 10 has a central sleeve 30 which is closed at its upper end 31 and which fits over the sleeve 25 of the flanged plate 27. A screw 32 threaded in the closed end of the sleeve rests on the upper end 26 of the sleeve 25 and forms a pivot permitting the dispensing tray to be rotated about the axis of the post 24. A handle 33 on the upper end of the screw 32 is manually rotatable to lower the dispensing tray towards the flanged plate 27. The flanged plate 27 is contoured to provide an annular outer area upwardly stepped from a central area to correspond with the dispensing tray, so that the bases of all the drinking vessels contact the plate simultaneously as the dispensing tray is lowered, and all the vessels are lifted out of their receiving apertures to enable them to be picked up.

A tilting handle 34 is secured to the shaft to permit tilting of the dispensing tray to the desired angle. Means for locking the handle when the tray has been tilted to the desired angle, comprise a locating disc 35 fixed to bracket 20 on the axis of shaft 23 and a locating pin 36 which is fitted into the handle and rides in a groove 37 in the locating disc 35. At the positions of the handle, corresponding to the level position, 15° tilt position, and upright position of the tray, the groove is formed with openings 38, 39, 40 into which the pin is biassed by a spring (not shown) to lock the handle at these positions.

When empty vessels have been replaced in the tray after consumption of the liquid, they can be readily washed simultaneously. The washing process is carried out when the lifting means have been operated to lift the vessels and ensure that the sealing surfaces of the vessels and tray are effectively cleansed. To facilitate washing, a suitable cover (not shown) is placed over the vessels to prevent them from falling out of the apertures, water is introduced between the cover and the tray through jet nozzles in the cover, and after washing the entire tray is rotated into the upright position to allow the vessels to drain before they are returned to the horizontal or level position for a further filling.

I claim:

1. Liquid dispensing apparatus comprising a peripherally flanged tray having a downwardly-stepped central area surrounded by an annular outer area, both areas of the tray containing a plurality of apertures, a plurality of drinking vessels removably fitted and sealed in said apertures, each said vessel having a rim thereof flush with the adjacent area of the tray in which the vessel is received.

2. Liquid dispensing apparatus comprising a tray, the surface of the tray having a central circular area surrounded by an annular area, an annular upward step separating said circular area from said annular area, an upwardly directed flange on the tray surrounding the annular area, each said area having a plurality of apertures therein, an equal plurality of drinking vessels removably sealed in said apertures with the rim of each vessel flush with the part of the tray defining the aperture in which it is received, means supporting the tray for rotation about an axis through its centre perpendicular to the plane of the central area, and means supporting the tray for tilting movement about a horizontal axis.

3. Liquid dispensing apparatus according to claim 2 further comprising a plate disposed below the tray and means for moving the tray relatively towards the plate thereby to lift the drinking vessels relatively to the tray out of their receiving apertures.

4. Liquid dispensing apparatus according to claim 2 wherein each drinking vessel is shaped as a frusto-conical shell.

5. Liquid dispensing apparatus according to claim 2 wherein a downwardly-directed flange of the tray surrounds each aperture.

* * * * *